United States Patent [19]

Weber

[11] Patent Number: 4,870,697

[45] Date of Patent: Sep. 26, 1989

[54] TWO-WAY COMMUNICATION SYSTEM FOR WINNING MACHINES IN UNDERGROUND MINING

[75] Inventor: Karl-Heinz Weber, Witten-Haven, Fed. Rep. of Germany

[73] Assignee: Gebr. Eickhoff Maschienenfabrik u. EisengieBerei mbH, Bochum, Fed. Rep. of Germany

[21] Appl. No.: 85,772

[22] Filed: Aug. 17, 1987

[30] Foreign Application Priority Data

Aug. 23, 1986 [DE] Fed. Rep. of Germany ..... 3628738

[51] Int. Cl.[4] ..... E21C 35/24; H01B 13/02

[52] U.S. Cl. ..... 455/70; 455/40; 299/1; 299/30

[58] Field of Search ..... 455/70, 40, 66; 299/30, 299/31; 405/258, 302

[56] References Cited

U.S. PATENT DOCUMENTS

| | | | |
|---|---|---|---|
| 3,362,750 | 1/1968 | Carnegie | 299/30 |
| 3,900,878 | 8/1975 | Tsao | 342/459 |
| 3,906,504 | 9/1975 | Guster et al. | 342/459 |
| 3,922,015 | 11/1975 | Poundstone | 299/30 X |
| 4,053,182 | 10/1977 | Nelson | 299/30 X |
| 4,167,290 | 9/1979 | Yamazaki et al. | 299/30 X |
| 4,367,900 | 1/1983 | Trümper | 299/30 X |

FOREIGN PATENT DOCUMENTS 0876997 11/1981 U.S.S.R. ..... 299/30

OTHER PUBLICATIONS

Warner, E. M., "Cable & Wireless Remote Control of Continuous Miners", Mining Congress Journal, Oct. 1974, pp. 34–39.

*Primary Examiner*—Thomas H. Tarcza
*Assistant Examiner*—John B. Sotomayor
*Attorney, Agent, or Firm*—Clifford A. Poff

[57] ABSTRACT

A two-way communication system for transmitting command signals to and receiving operating data from a winning machine utilized in underground mining operations. The system includes a send-receive facility positioned remote from the winning machine for transmitting command information to the winning machine. A receiving means is positioned at the winning machine for receiving signals sent by the send-receive facility, and a transmitting means is positioned at the winning machine for transmitting signals corresponding to operating data of the winning machine. The send-receive facility receives the information transmitted by the transmitting means, and a separable memory is separably attached to the send-receive facility for storing such operating data and the command information. Because the memory is separable, the memory may be removed to allow the data contained therein to be analyzed at a remote location.

12 Claims, 2 Drawing Sheets

TWO-WAY COMMUNICATION SYSTEM FOR WINNING MACHINES IN UNDERGROUND MINING

BACKGROUND OF THE INVENTION

1. Field of the Invention

The present invention relates generally to communication systems, and, more particularly, to a two-way communication system to allow remote operation of a winning machine utilized in underground mining.

2. Description of the Prior Art

Winning operations which involve long wall mining procedures most advantageously utilize drum cutter mining machines. Conventionally, a drum cutter mining machine, also referred to as a shearer loader, includes at least one, and usually two, circular cutting drums which, when caused to rotate, shear a mineral from the mine wall proximate to the cutter drums. Typically, a first cutting drum, referred to as the leading cutting drum, is positioned at an angle extending above the shearer-loader. A second cutting drum, referred to as the trailing cutting drum, is positioned at an angle depending from the shearer loader. During operation of the shearer-loader to shear the mineral from the mine wall, the leading cutting drum shears a first portion of the mine wall and the trailing cutting drum shears a second portion of the mine wall. Preferably, the overlapping between the two sheared portions is minimized. In order to provide for an efficient operation of the shearer-loader, an operator controls the angles at which the leading cutting cutting drum and the trailing cutting drum extend and depend, respectively, from the shearer-loader.

Known in the art are radio controlled transmitters which may be utilized to remotely transmit operating instructions to allow operation of winning machines. One such example has been described in an article in *German Mining Magazine* of March 1985, entitled, "The Supervision and Control of Road-Heading Machines". The system discloses not only a transmitting means to control operation of the winning machine, but also a receiving and storage mechanism to receive data from the winning machine and store such data. This data, analyzed in conjunction with the command signals utilized to control the winning machine, are an important diagnostic tool. The system disclosed in the article provides a means by which this data is transmitted by a pulse code modulation system to an underground roadway control station or the central mine control station. Such a system, however, requires a hard wire connection between the winning machine and the respective control station. Because the location of the winning machine is constantly changing during mining operations, such a requirement is inconvenient and at times burdensome.

It is therefore the object of the present invention to provide a system to overcome the problems inherent in the prior art.

It is a further object of the present invention to provide a two-way communication system to allow operation of an underground shearer-loader machine which allows a winning machine, such as a shearer-loader, to be remotely controlled, and which further allows operating data of the winning machine to be transmitted from the winning machine to allow analysis of such data.

It is a still further object of the present invention to provide a separable storage means to allow storage of the operating data of the winning machine and to allow storage of the operating commands sent to the winning machine to allow analysis of such information at a later point in time, and at a remote location.

SUMMARY OF THE PRESENT INVENTION

In accordance with the present invention, a two-way communication system for transmitting command signals to and receiving operating data from a winning machine utilized in underground mining operations is disclosed. The system includes a send-receive facility positioned remote from the winning machine for transmitting operating instructions to the winning machine and for receiving operating data from the winning machine. The send-receive facility may be comprised of, for example, a modulating means, a demodulating means, a high-frequency transmitter, a high frequency receiver and a battery power means electrically coupled so as to form a two-way radio frequency transmitter/-receiver. A receiving means is positioned at the winning machine to receive operating instructions transmitted by the send-receive facility. A control means is electrically coupled to the radio receiving means for controlling the winning machine responsive to the operating instructions received by the receiving means and for generating operating data responsive to the operation of the winning machine. A transmitting means is electrically coupled to the control means for transmitting the operating data to the send-receive facility. A separable memory means is separably coupled to the send-receive facility for storing instruction data corresponding to the operating instructions transmitted to the winning machine and for storing the operating data received from the winning machine. Because the memory means is separable, the memory may be removed from the send-receive facility and remotely analyzed without the requirement of an electrical connection between the winning machine and a remote location. The memory means may be comprised of, for example, a magnetic disk. Alternatively, the memory means may be comprised of a bubble memory, a tape memory, or a static memory. Preferably, the send-receive facility further includes a display means for displaying information, and a keypad entry means to allow manual entry of control commands by an operator.

BRIEF DESCRIPTION OF THE DRAWINGS

The present invention may be more fully understood when read in light of the accompanying drawings in which.

DETAILED DESCRIPTION OF THE PREFERRED EMBODIMENT

Figure 1:
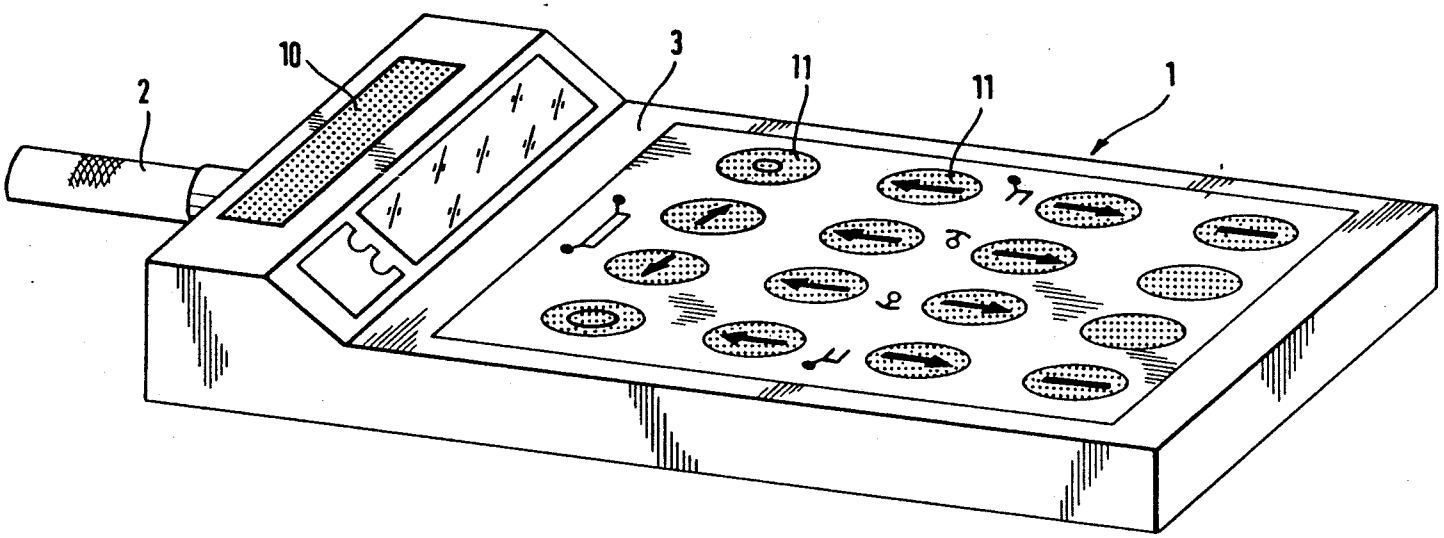
FIG. 1 is a perspective illustration of the send-receive facility utilized by the two-way communication system of the present invention which allows the transmission of operating instructions to the winning machine, the reception of operating data from the winning machine, and memory means to allow storage of the information.

Referring now to the perspective illustration of FIG. 1, there is shown the send-receive facility, referred to generally as 1, utilized in the present invention. The system of the present invention will be described in conjunction with a drum cutter shearer-loader, but it is to be understood that the present invention may be similarly utilized with other types of winning machines.

Send-receive facility 1 is positioned remote from a shear-loader (not shown) to allow operation thereof by an operator. The send-receive facility 1 contains antenna 2 to allow transmission of signals to the shearer-loader, and is surrounded by a protective casing 3.

Figure 2:
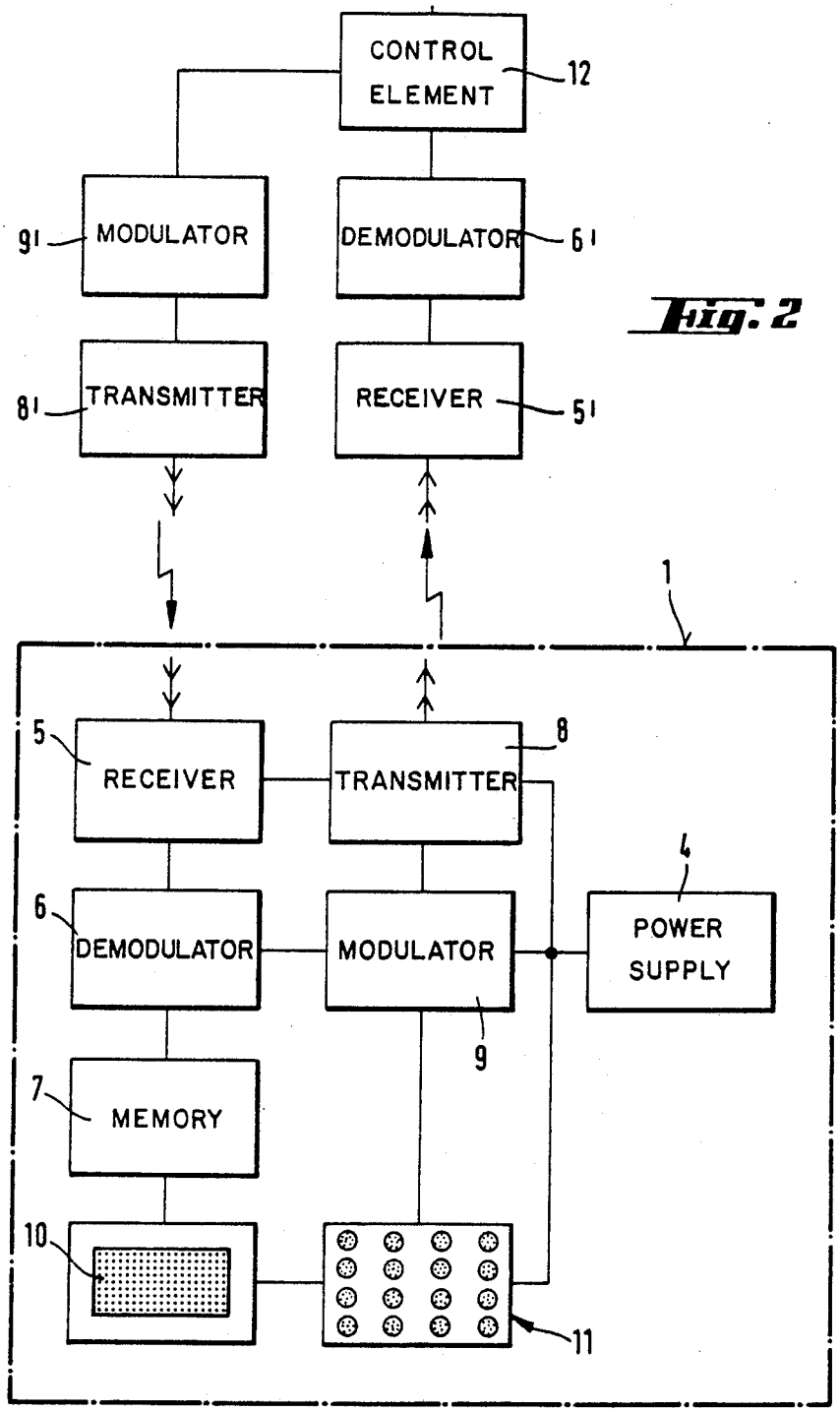
FIG. 2 is a block diagram of the various components which comprise the two-way communication system of the present invention.

Referring now to the block diagram of FIG. 2, the send-receive facility 1 is shown to be comprised of a power supply 4, high-frequency receiver 5, pulse code modulation receiver 6, separable memory 7, high-frequency transmitter 8, and pulse code modulation transmitter 9. Further illustrated in both of the Figures are the input/output devices comprising light emitting diode display 10 and keypad 11. Keypad 11 is coupled to both transmitter 9 and LED display 10. Keypad 11 allows an operator to enter commands to be transmitted by send-receive facility 1. The commands entered through keypad 11 are also displayed on the LED display 10, and stored in separable memory 7 having an electronic memory. The separable memory is inductively or electrically coupled to the send-receive facility formed by the components housed therewith by the protective casing 3.

Positioned at the shearer-loader, and shown in block form in the upper portion of FIG. 2, is receiver 5' which is coupled to pulse code modulation receiver 6', which is, in turn, coupled to control element 12. Control element 12, responsive to the signals received by receiver 5', produces new signals to operate the relays of the shearer-loader. Control element 12 is further coupled to transmitter 9', which is, in turn, coupled to transmitter 8' to transmit operator data of the shearer-loader determined by control element 12.

In operation, the two-way communication system of the present invention is operative to allow an operator to remotely control a shearer-loader, and, additionally, to receive operating data from the shearer-loader. The operator enters command information into keypad 11 to thereby supply desired control commands to pulse code modulation transmitter 9, and, in turn, to high-frequency transmitter 8. The data input into keypad 11 is also displayed on LED diode display 10 of the send-receive facility 1, and stored in separable memory 7. Transmitter 8 of the send-receive facility 1 transmits a signal indicative of the control commands input by the operator. The signal is received at the shearer-loader by high-frequency receiver 5'. The received signal is supplied to pulse code modulation receiver 6', which, in turn, provides signal to control element 12. Control element 12 energizes and deenergizes relays, and actuates and deactuates other systems responsive to the signal supplied to the element 12 by modulation receiver 6'. Control element 12 also supplies operating data concerning the shearer-loader to pulse code transmitter 9'. Pulse code transmitter 9', in turn, supplies this data to high frequency transmitter 8'. Transmitter 8' transmits a signal indicative of this data. High frequency receiver 5 of the send receive facility 1 receives the signal transmitted by transmitter 8' and supplies the signal to pulse code modulation receiver 6, where it, in turn, is supplied to separable memory 7.

Thus, separable memory 7 is supplied, and stores, both the command signals transmitted by the send-receive facility 1, and the operating data received from control element 12 of the shearer-loader. Because the memory 7 is separable from the send-receive facility 1, memory 7 may be removed from send-receive facility 1, to allow analysis of the information stored therein at a remote location. In the preferred embodiment, the separable memory is comprised of a magnetic disk. Quite conveniently, then, the memory may be removed from the facility 1 and replaced with a new memory 7, at, for example, a the end of a shift or between cuts of the shearer-loader. Such a system thereby obviates the need for wiring, or the like, to transmit the operating data and operating orders to a remote location for analysis purposes.

While the present invention has been described in connection with the preferred embodiment shown in FIGS. 1 and 2, it is to be understood that other similar embodiments may be used or modifications or additions may be made to the described embodiment for performing the same function of the present invention without deviating therefrom. Therefore, the present invention should not be limited to any single embodiment, but rather construed in breadth and scope in accordance with the recitation of the appended claims.

What I claim is:

1. A two-pay communication system for transmitting command signals to and receiving operating data from a winning machine used in underground mining operations, said system including:

a send-receive facility housed in a protective casing remote from said winning machine for transmitting operating instructions to said winning machine and for receiving operating data from said winning machine.

receiving means positioned at the winning machine for receiving said operating instructions transmitted by the send-receive facility;

control means electrically coupled to said receiving means for controlling said winning machine in response to said operating instructions received by said receiving means and for generating operating data responsive to operation of said winning machine;

transmitting means electrically coupled to said control means for transmitting said operating data to the send-receive facility; and memory means housed in said protective casing for storing instructions data corresponding to the operating instructions transmitted to the winning machine and for storing the operating data received from the winning machine, said memory means being physically separable from said casing at a location remote to said winning machine.

2. The communication system of claim 1 wherein said send-receive facility includes a modulator, a demodulator, a high frequency transmitter, a high frequency receiver, a display means and a power supply means electrically coupled so as to form a two-way radio frequency transmitter/receiver.

3. The communication system of claim 2 wherein said send-receive facility further includes a keypad input means for inputting data to be transmitted by the send-receive facility.

4. The communication system of claim 1 wherein said separable memory means is electrically coupled to the send-receive facility.

5. The communication system of claim 1 wherein said separable memory means is inductively coupled to the send-receive facility.

6. The communication system of claim 1 wherein said separable memory means includes an electromagnetic memory.

7. A send-receive facility for sending operating instructions to and receiving operating data from a winning machine utilized in underground mining operations, said facility including means forming a radio frequency transmitter and receiver, including a protective casing enclosing a modulator, a demodulator, a high frequency transmitter, a high frequency receiver, a power supply means, and memory means, said memory means being coupled within said protective casing for storing data corresponding to the operating instructions transmitted to the winning machine and for storing operating data received from the winning machine, said memory means being decoupled and physically separable from said protective casing to allow evaluation of said instruction data and said operating data stored therewith at a location remote to the winning machine and the protective casing.

8. The send-receive facility of claim 7 further including a display means for displaying information.

9. The send-receive facility of claim 7 further including a keypad input means for inputting data to the send-receive facility.

10. The send-receive facility of claim 7 wherein said separable memory means is inductively coupled to the send-receive facility.

11. The send-receive facility of claim 7 wherein said separable memory means is electrically coupled to the send-receive facility.

12. The send-receive facility of claim 7 wherein said separable memory means includes an electromagnetic memory means.

* * * * *